US012545453B2

(12) United States Patent
Ries

(10) Patent No.: US 12,545,453 B2
(45) Date of Patent: Feb. 10, 2026

(54) STRAPPING MACHINE WITH A WELDING ASSEMBLY HAVING A LEADING-STRAP-END GUIDE

(71) Applicant: Signode Industrial Group LLC, Tampa, FL (US)

(72) Inventor: Stefan Ries, Bindlach (DE)

(73) Assignee: Signode Industrial Group LLC, Tampa, FL (US)

( * ) Notice: Subject to any disclaimer, the term of this patent is extended or adjusted under 35 U.S.C. 154(b) by 0 days.

(21) Appl. No.: 18/839,851

(22) PCT Filed: Feb. 16, 2023

(86) PCT No.: PCT/US2023/062706
§ 371 (c)(1),
(2) Date: Aug. 20, 2024

(87) PCT Pub. No.: WO2023/164397
PCT Pub. Date: Aug. 31, 2023

(65) Prior Publication Data

US 2026/0021917 A1 Jan. 22, 2026

Related U.S. Application Data

(60) Provisional application No. 63/268,512, filed on Feb. 25, 2022.

(51) Int. Cl.
*B65B 13/04* (2006.01)
*B65B 13/32* (2006.01)
*B65B 65/02* (2006.01)

(52) U.S. Cl.
CPC ..... *B65B 13/04* (2013.01); *B65B 13/32* (2013.01); *B65B 65/02* (2013.01)

(58) Field of Classification Search
CPC ..... B65B 13/04; B65B 13/32; B65B 65/02
See application file for complete search history.

(56) References Cited

U.S. PATENT DOCUMENTS 3,470,814 A 10/1969 Tschappu
4,016,023 A 4/1977 Takami
(Continued)

FOREIGN PATENT DOCUMENTS

CH 704089 A2 5/2012
CN 113650838 A 11/2021
(Continued)

OTHER PUBLICATIONS

"EAM Mosca Strapping Systems' "UATRI-2XT Strapping Machine" Brochure", available at: https://www.eammosca.com/product/uatri-2xt/, Nov. 2, 2022.
"Mosca UATRI machine", video of machine in operation, available before the priority date of this patent application.
"Spareparts Catalogue MOSCA UATRI", available before the priority date of this patent application.
(Continued)

*Primary Examiner* — Himchan Song
(74) *Attorney, Agent, or Firm* — Neal. Gerber & Eisenberg LLP

(57) ABSTRACT

Various embodiments of the present disclosure provide a strapping machine with a welding assembly including a counter-pressure plate and a heating element that cooperate to attach two overlapping portions of strap to each other to form a loop of strap around a load. The welding assembly includes two strap clamps that clamp a leading strap end of the strap at various points in time during a strapping cycle. The welding assembly also includes a leading-strap-end guide positioned and movable to guide the leading end of the strap after the strap is released from the two strap clamps and to clamp a portion of the strap adjacent the leading strap end against the counter-pressure plate.

11 Claims, 16 Drawing Sheets

(56) References Cited

U.S. PATENT DOCUMENTS

| | | | | |
|---|---|---|---|---|
| 4,435,945 | A | 3/1984 | Roehrig | |
| 4,512,844 | A * | 4/1985 | Kobiella | B29C 66/1122 100/33 PB |
| 4,850,179 | A * | 7/1989 | Takami | B65B 13/22 53/589 |
| 5,170,612 | A * | 12/1992 | Sumino | B65B 13/08 53/589 |
| 5,513,482 | A | 5/1996 | Nagashima et al. | |
| 6,915,624 | B2 * | 7/2005 | Shibazaki | B65B 13/32 53/589 |
| 7,716,900 | B2 * | 5/2010 | Schmetzer | B65B 13/32 53/399 |
| 10,865,004 | B2 | 12/2020 | Tanner | |
| 2018/0022489 | A1 * | 1/2018 | Tanner | B41J 2/32 53/399 |
| 2021/0094714 | A1 * | 4/2021 | Hoffman | B65B 13/24 |
| 2021/0394940 | A1 * | 12/2021 | Lai | B65B 13/325 |
| 2024/0150052 | A1 * | 5/2024 | Richter | B65B 13/187 |

FOREIGN PATENT DOCUMENTS

| | | | |
|---|---|---|---|
| DE | 2437229 | A1 | 2/1976 |
| DE | 3929710 | C2 | 6/1993 |
| DE | 9418542 | U1 | 1/1995 |
| EP | 0178385 | A1 | 4/1986 |
| EP | 0401554 | A1 | 12/1990 |
| EP | 0403190 | A2 | 12/1990 |
| EP | 2149448 | A2 | 2/2010 |
| EP | 3798143 | A1 | 3/2021 |
| WO | 9215486 | A1 | 9/1992 |

OTHER PUBLICATIONS

"International Search Report and Written Opinion", from corresponding International Patent Application No. PCT/US2023/062706, Jul. 28, 2023.

* cited by examiner

STRAPPING MACHINE WITH A WELDING ASSEMBLY HAVING A LEADING-STRAP-END GUIDE

PRIORITY CLAIM

This application is a national phase application of PCT/US2023/062706, filed on Feb. 16, 2023, which claims priority to and the benefit of U.S. Provisional Patent Application No. 63/268,512, filed Feb. 25, 2022, the entire contents of which is incorporated herein by reference.

FIELD

The present disclosure relates to a strapping machine for strapping loads, and more particularly to a strapping machine with a welding assembly including a counter-pressure plate and a heating element that cooperate to attach two overlapping portions of strap to each other to form a loop of strap around a load.

BACKGROUND

A strapping machine forms a loop of plastic strap (such as polyester or polypropylene strap), metal strap (such as steel strap), or paper strap around a load. A typical strapping machine includes a support surface that supports the load, a strapping head that forms the strap loop, a controller that controls the strapping head to strap the load, and a frame that supports these components. A typical strapping head includes a sealing assembly for cutting the strap from the strap supply and attaching two overlapping portions of the strap together to form the strap loop. There are many different types of strap-sealing assemblies that attach the overlapping portions of the strap to one another in different ways. Certain strapping machines configured for plastic strap include a sealing assembly with a friction welder, a heating element (such as a hot knife), or an ultrasonic welder configured to attach the leading and trailing strap ends to one another. Some strapping machines configured for plastic strap or metal strap include a sealing assembly with jaws that mechanically deform (referred to as "crimping" in the industry) or cut notches into (referred to as "notching" in the industry) a seal element positioned around the leading and trailing strap ends to attach them to one another. Other strapping machines configured for metal strap include a sealing assembly with punches and dies configured to form a set of mechanically interlocking cuts in the leading and trailing strap ends to attach them to one another (referred to in the strapping industry as a "sealless" attachment). Still other strapping machines configured for metal strap include a sealing assembly with spot, inert-gas, or other welders configured to weld the leading and trailing strap ends to one another.

SUMMARY

Various embodiments of the present disclosure provide a strapping machine with a welding assembly including a counter-pressure plate and a heating element that cooperate to attach two overlapping portions of strap to each other to form a loop of strap around a load. The welding assembly includes two strap clamps that clamp a leading strap end of the strap at various points in time during a strapping cycle. The welding assembly also includes a leading-strap-end guide positioned and movable to guide the leading end of the strap after the strap is released from the two strap clamps and to clamp a portion of the strap adjacent the leading strap end against the counter-pressure plate.

DETAILED DESCRIPTION

Figure 1A:
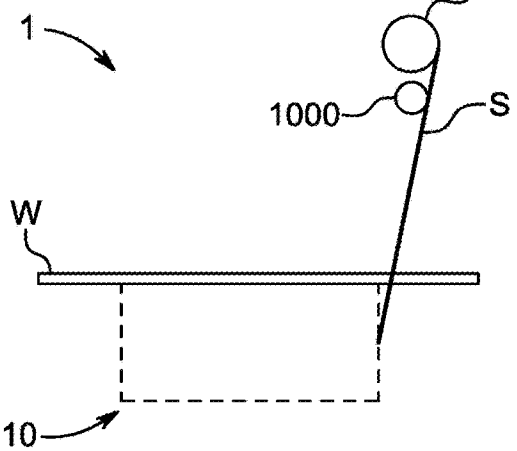
FIGS. 1A-1E are diagrammatic side views of one example embodiment of a strapping machine of the present disclosure strapping a load.

While the systems, devices, and methods described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, connected, etc., are not intended to be limited to direct mounting methods but should be interpreted broadly to include indirect and operably mounted, connected, and like mounting methods. This specification is intended to be taken as a whole and interpreted in accordance with the principles of the present disclosure and as understood by one of ordinary skill in the art.

Figure 1B:
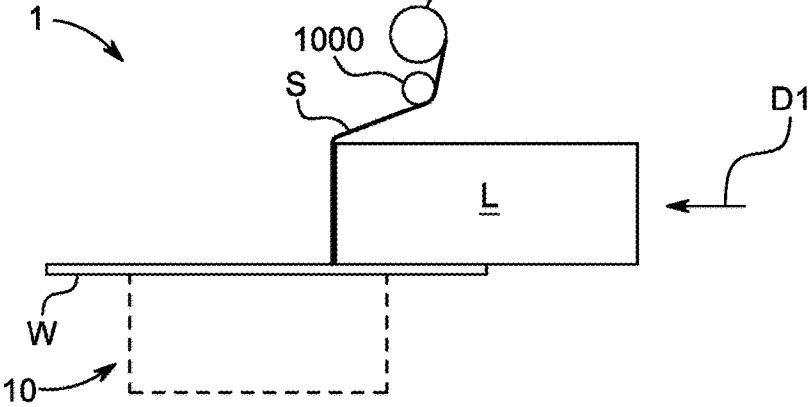
Figure 1C:
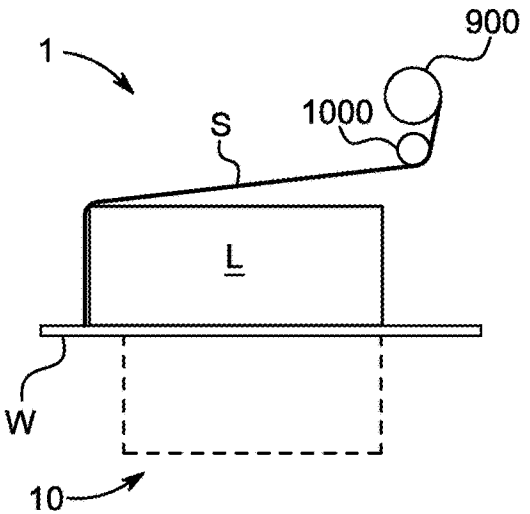
Figure 1D:
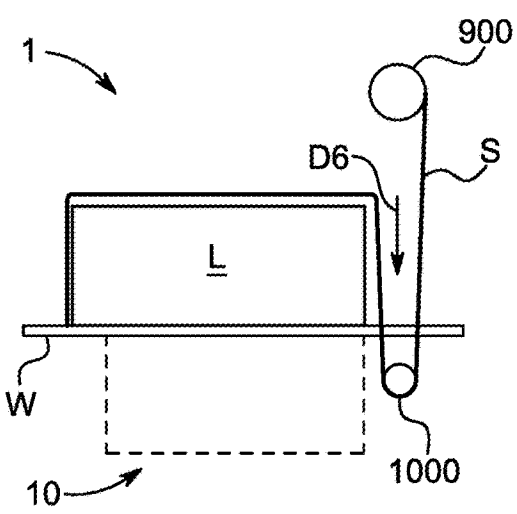
Figure 1E:
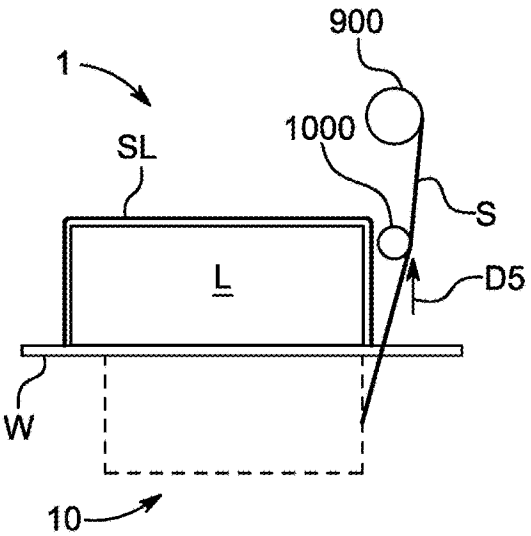
Figure 2:
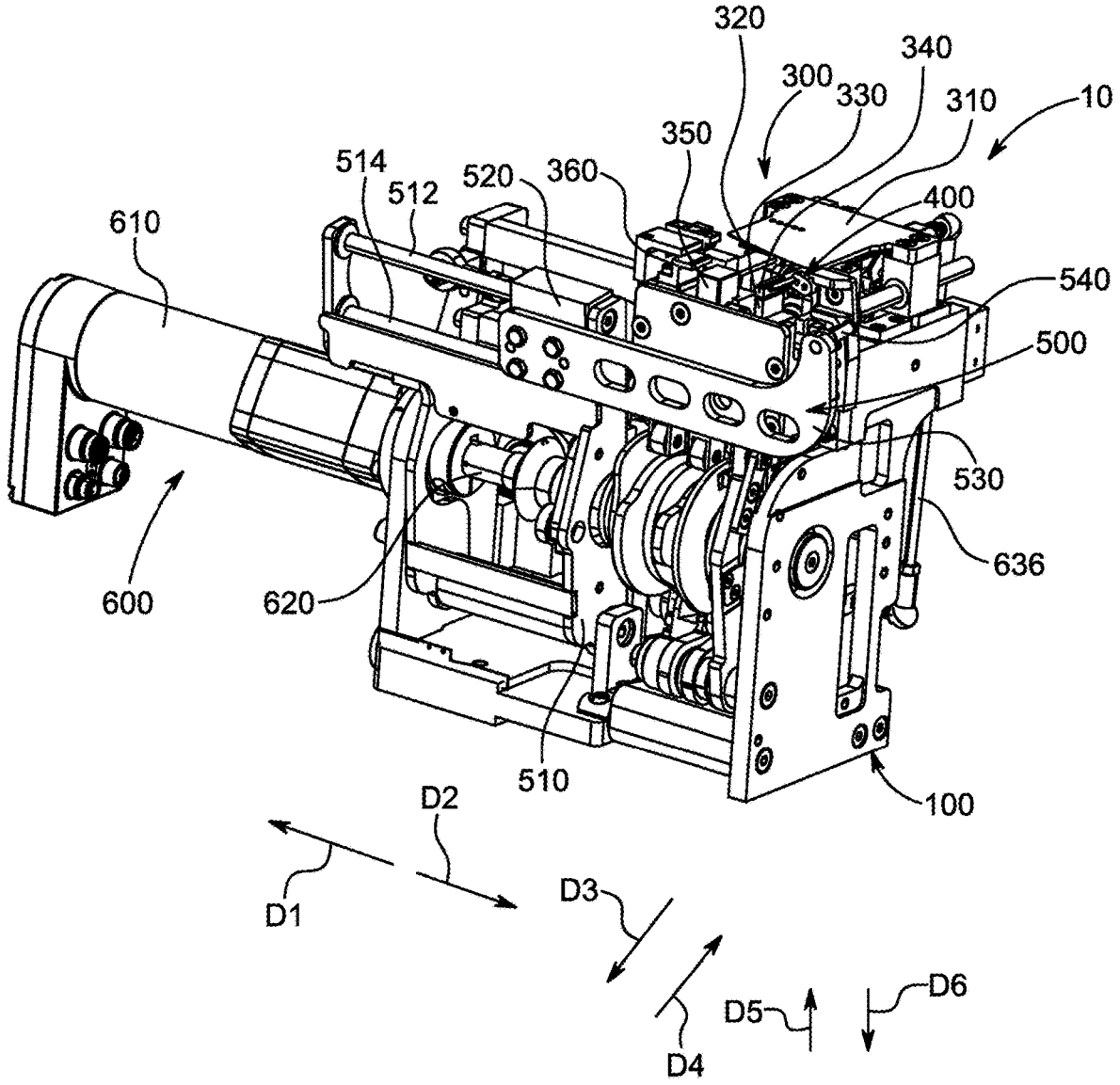
FIG. 2 is a perspective view of the sealing assembly of the strapping machine of FIGS. 1A-1E.

FIGS. 1A-5L show one example embodiment of a strapping machine 1 of the present disclosure and certain assemblies and components thereof. The strapping machine 1 includes a strapping-machine frame (not shown for clarity), a work platform W supported by the strapping-machine frame, a sealing assembly 10 below the work platform W, a strap supply 900 supported by the strapping-machine frame above the work platform 900, a first strap manipulator 1000 supported by and movable relative to the strapping-machine frame, and a controller (not shown). FIG. 2 identifies first, second, third, fourth, fifth, and sixth directions D1, D2, D3, D4, D5, and D6 that are referred to throughout this detailed description to identify movement directions of various components of the strapping machine 1. In this embodiment, the first and second directions D1 and D2 are opposite directions, the third and fourth directions D3 and D4 are opposite directions, and the fifth and sixth directions D5 and D6 are opposite directions. The first and second directions D1 and D2 are transverse to (and in this example embodiment perpendicular to) the third and fourth directions D3 and D4 and the fifth and sixth directions D5 and D6. Additionally, the third and fourth directions D3 and D4 are transverse to (and in this example embodiment perpendicular to) the fifth and sixth directions D5 and D6 such that the pairs of opposing directions are all transverse to (and in this example embodiment perpendicular to) one another.

FIGS. 1A-1E show the strapping machine 1 carrying out a strapping cycle to form a loop SL of strap S around a load L, such as a stack of flattened corrugated boxes. Initially, as shown in FIG. 1A, the sealing assembly 10 clamps the leading end (not shown) of the strap S below the work platform W, the strap S extends from the sealing assembly 10 to the strap supply 900, and the first strap manipulator 1000 is in a home position near the strap supply 900. As shown in FIG. 1B, the load L is positioned atop the work platform W and moved by a conveyor in the first direction D1. The leading end of the load L contacts the strap S, and as the conveyor continues to move the load L in the first direction D1, the movement of the load L relative to the strap supply 900 combined with the sealing assembly 10 clamping the leading strap end results in strap S being pulled from the strap supply 900 and extending across the top surface of the load L. The conveyor stops moving the load L once the load L reaches a welding position over the sealing assembly 10, as shown in FIG. 1C. The first strap manipulator 1000 descends in the sixth direction D6 from its home position to a sealing position below the work platform W and adjacent the sealing assembly 10, as shown in FIG. 1D. This movement extends the strap S behind the trailing end of the load L. After the first strap manipulator reaches the sealing position, the sealing assembly 10 manipulates the strap S, cuts the strap S from the strap supply 900 to form a trailing strap end, and welds portions of the strap adjacent the leading and trailing strap ends together to form a loop of strap S around the load L, as shown in FIGS. 5C-5L and described in detail below. This process also results in the sealing assembly 10 forming and clamping a new leading strap end (not shown) in preparation for the next strapping cycle. As shown in FIG. 1E, the first strap manipulator 1000 begins moving in the fifth direction D5 back to its home position in preparation for the next strapping cycle. While the strap loop SL is formed tight on the load L, in certain of FIGS. 1A-1E the strap loop SL is shown spaced apart from the load L for clarity.

FIGS. 2-5L show the sealing assembly 10, which manipulates strap to form a strap loop around a load. As best shown in FIG. 2, the sealing assembly 10 includes a sealing-assembly frame 100, a welding assembly 300, and a drive assembly 600.

Figure 3:
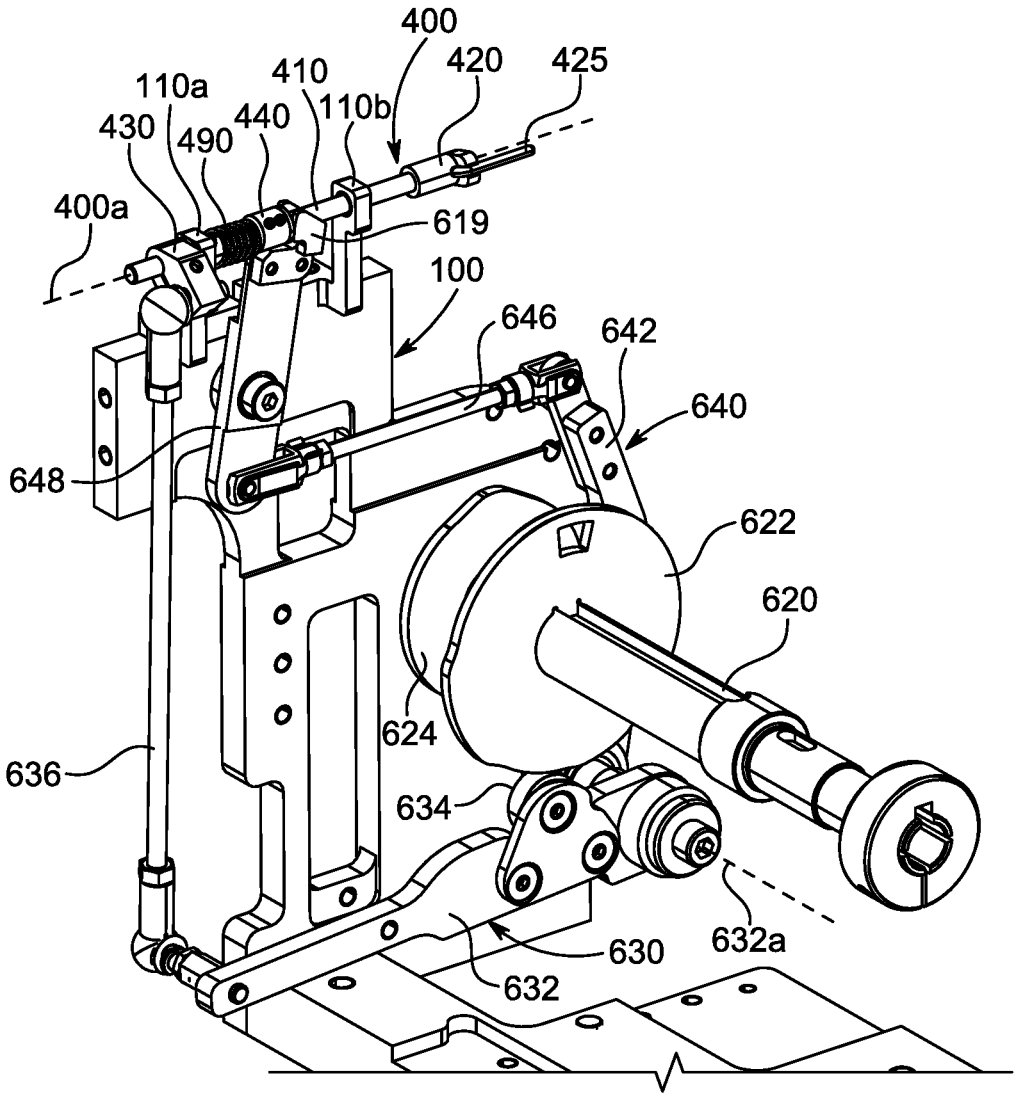
FIG. 3 is a perspective view of the leading-strap-end guide, the first and second leading-strap-end-guide actuators, part of the sealing-assembly frame, and part of the drive assembly of the sealing assembly of FIG. 2.
Figure 4:
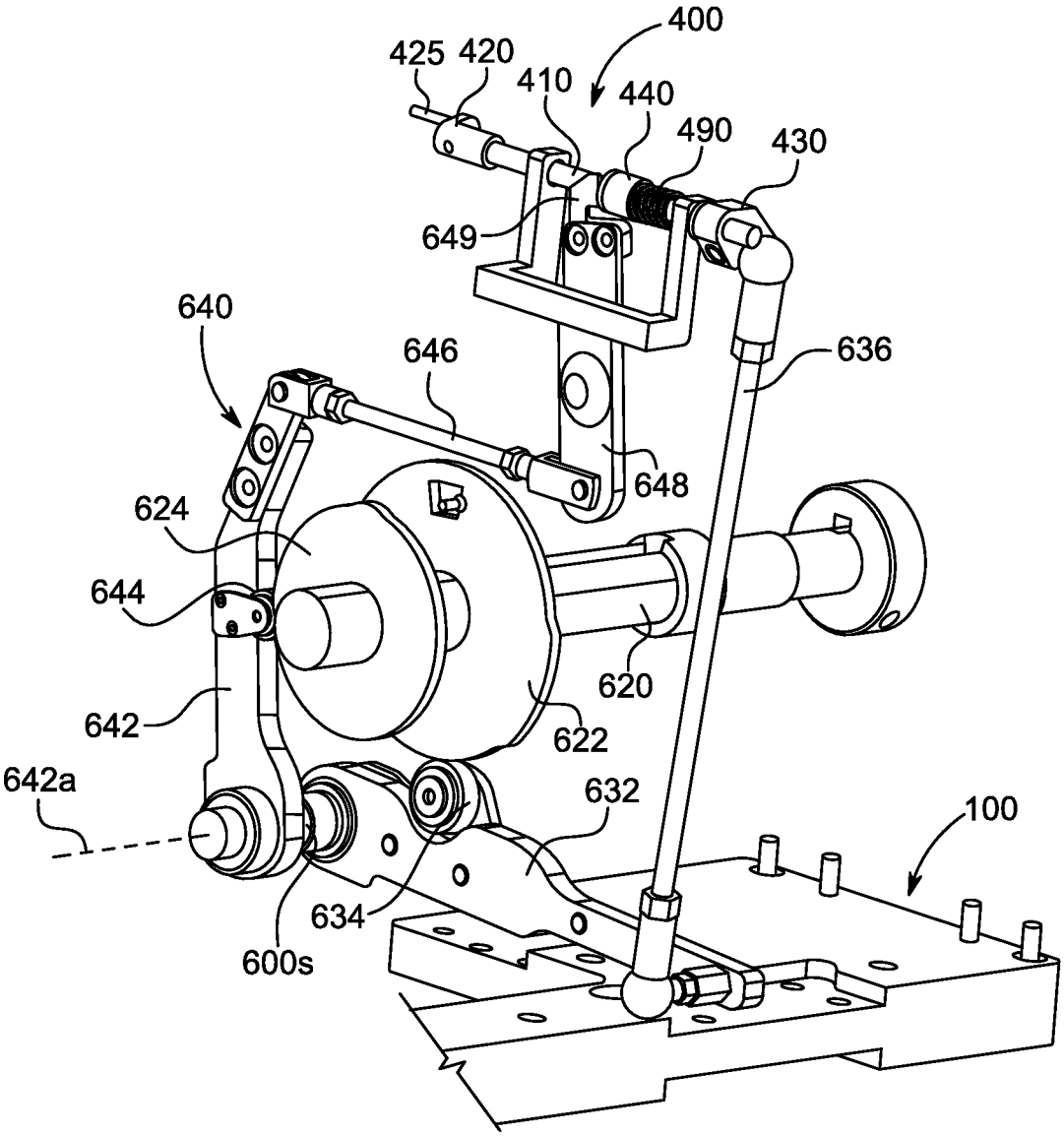
FIG. 4 is a cross-sectional perspective view showing the components of FIG. 3 from the opposite side.

The sealing-assembly frame 100, which is best shown in FIGS. 2-4, supports some (or all) of the other components of the sealing assembly 10 and may be formed of any suitable components arranged in any suitable configuration. In this example embodiment, the sealing-assembly frame 100 is attached to the underside of the work platform W in any suitable manner, though in other embodiments the sealing-assembly frame 100 may be attached to the strapping-machine frame instead of or in addition to the work platform W.

The welding assembly 300, which is best shown in FIGS. 2-5L, manipulates, cuts, and welds the strap to form the strap loop around the load. The welding assembly 300 includes a counter-pressure plate 310 having upper and lower surfaces 310*u* and 3101, a heating element 320 having upper and lower surfaces 320*u* and 3201, a first strap clamp 330 having a clamping surface 330*s*, a second strap clamp 340 having upper and lower clamping surfaces 340*u* and 3401, a third strap clamp 350 having a clamping surface 350*s*, a fourth strap clamp 360 having a clamping surface 360*s*, a leading-strap-end guide 400, and a second strap manipulator 500.

Figure 5A:
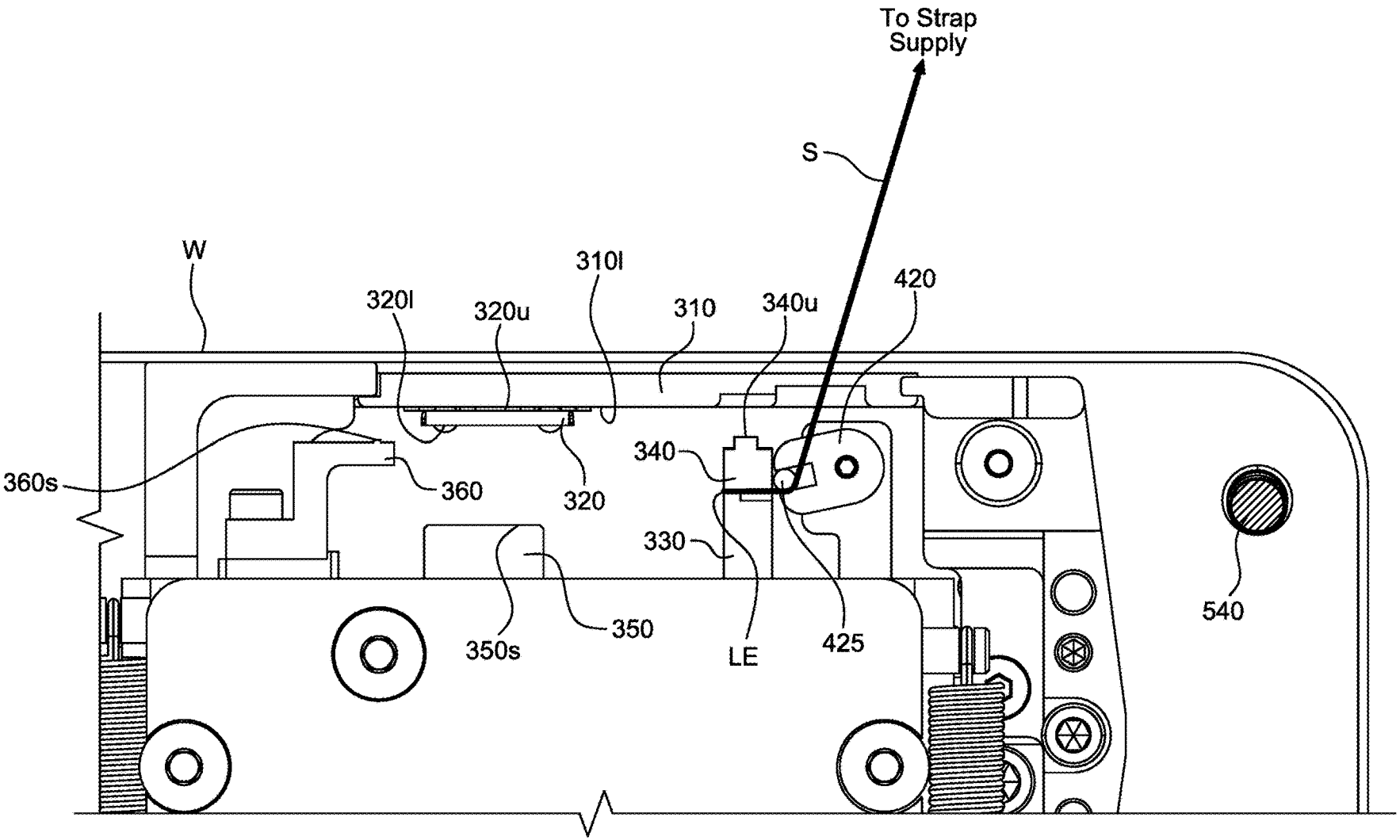
FIGS. 5A-5L are side views of part of the welding assembly of the sealing assembly of FIG. 2 during various stages of a strapping cycle.
Figure 5B:
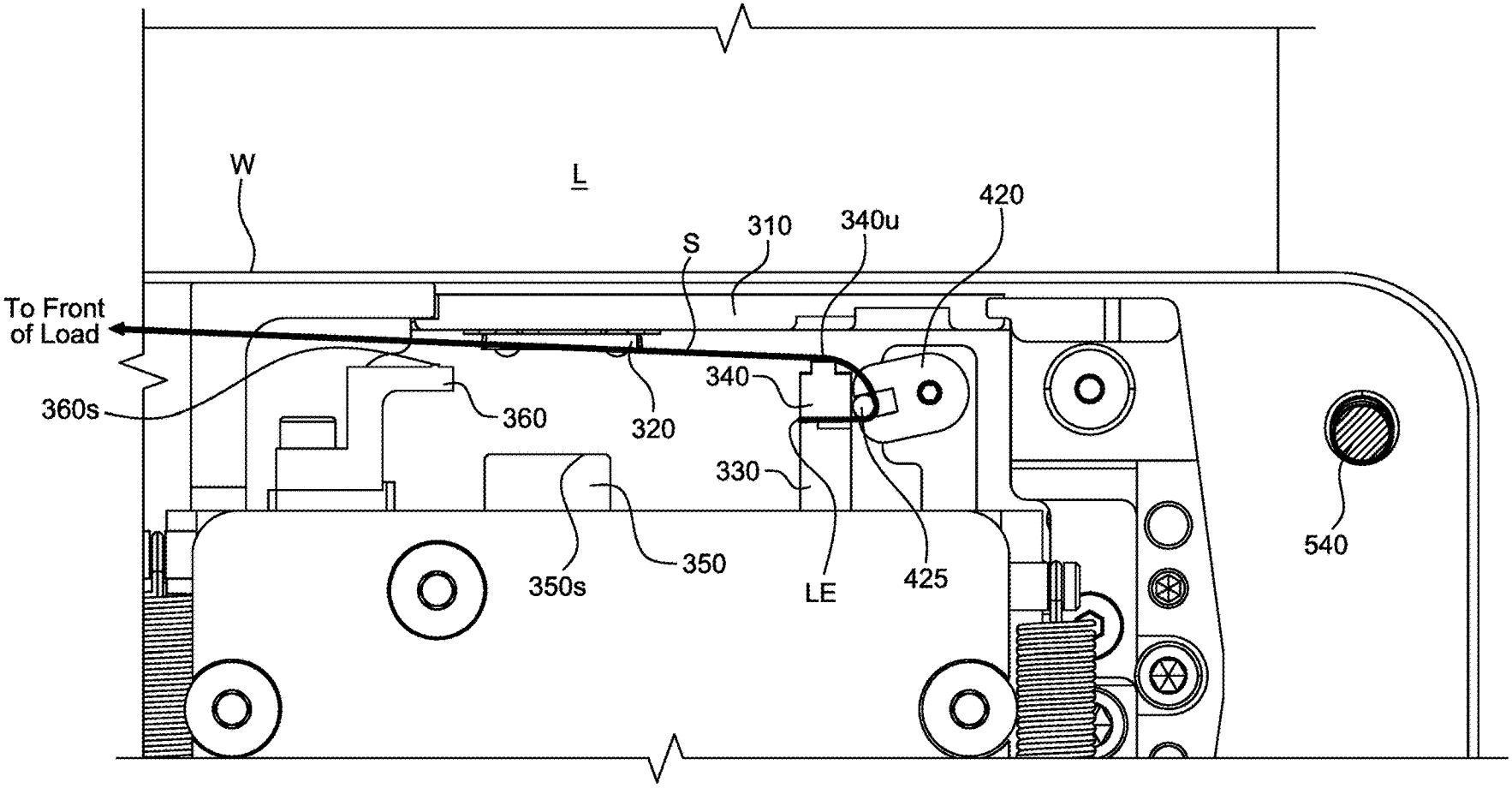
Figure 5C:
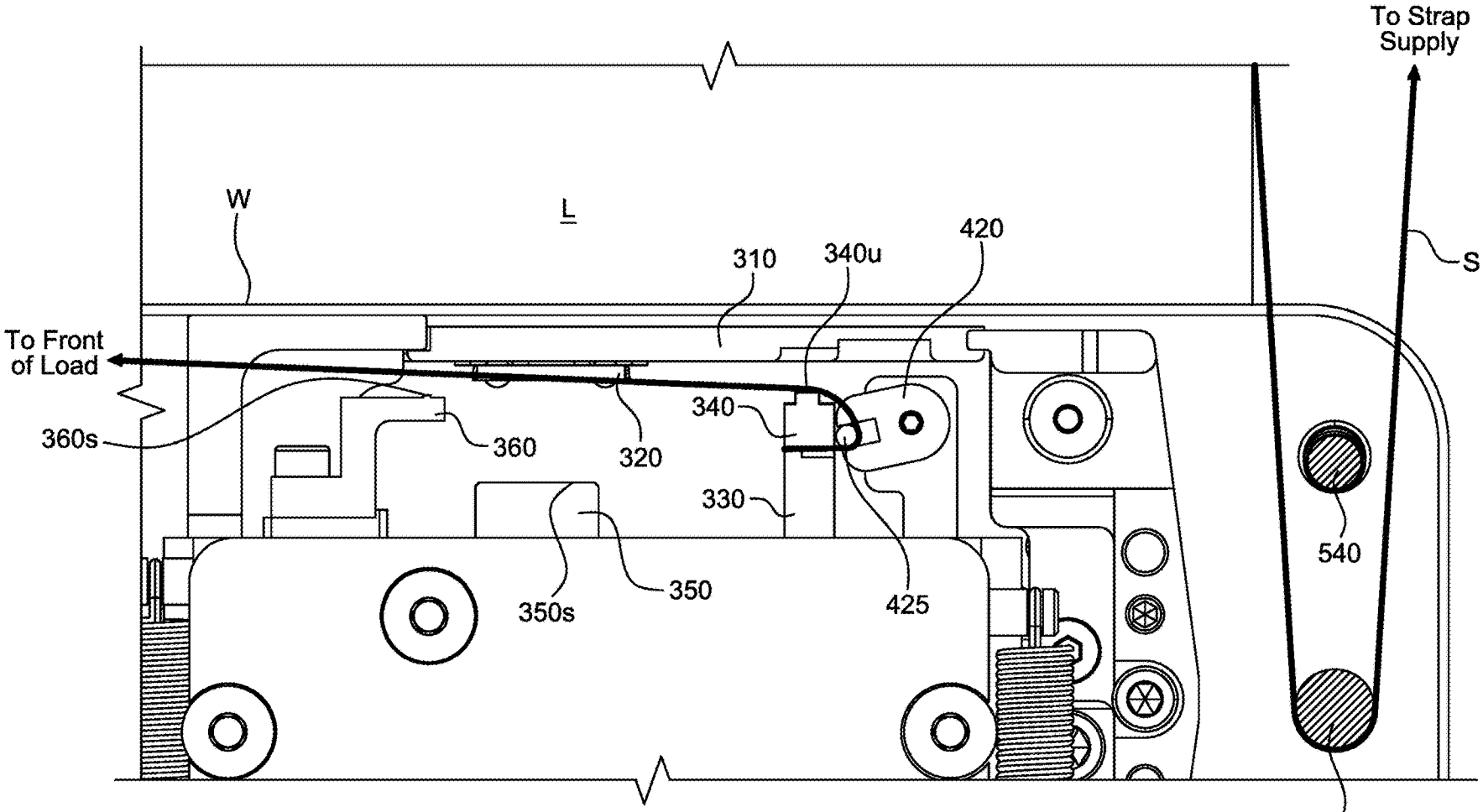
Figure 5D:
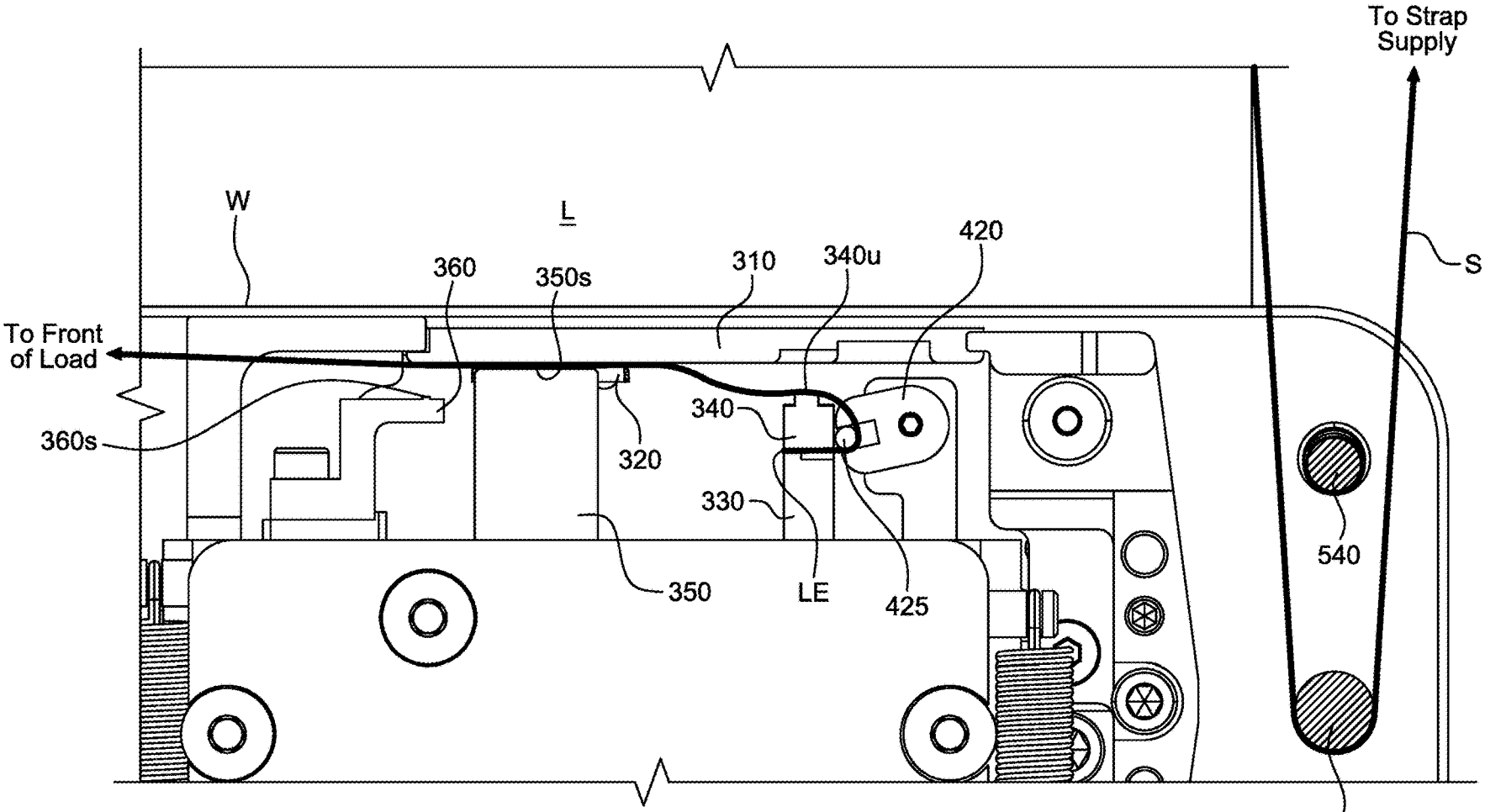

The drive assembly 600 is operably connected to the counter-pressure plate 310 to move the counter-pressure plate 310 in the third and fourth directions D3 and D4 and relative to the other components of the welding assembly 300 between a home position (FIGS. 2 and 5A) and a sealing position (FIG. 5C). The drive assembly 600 is operably connected to the heating element 320 to move the heating element 320 in the third and fourth directions D3 and D4 between a home position (FIG. 5A) and a sealing position (FIG. 5I). The drive assembly 600 is operably connected to the first strap clamp 330 to move the first strap clamp 330 in the fifth and sixth directions D5 and D6 and relative to the other components of the welding assembly 300 among a first clamping position (FIG. 5A), a release position (FIG. 5E), and a second clamping position (FIG. 5H). The drive assembly 600 is operably connected to the second strap clamp 340 to move the second strap clamp 340 in the third, fourth, fifth, and sixth directions D3, D4, D5, and D6 and relative to the other components of the welding assembly 300 among a first clamping position (FIG. 5A), a release position (FIG. 5E), and a second clamping position (FIG. 5H). The drive assembly 600 is operably connected to the third strap clamp 350 to move the third strap clamp 350 in the fifth and sixth directions D5 and D6 and relative to the other components of the welding assembly 300 among a release position (FIG. 5A), a first clamping position (FIG. 5D), and a second clamping position (FIG. 5J). The drive assembly 600 is operably connected to the fourth strap clamp 360 to move the fourth strap clamp 360 in the fifth and sixth directions D5 and D6 and relative to the other components of the welding assembly 300 between a release position (FIG. 5A) and a clamping position (FIG. 5D). These operative connections are explained in more detail below.

The leading-strap-end guide 400, which is best shown in FIGS. 3 and 4, includes a shaft 410 having a longitudinal axis 400*a*, a strap-engager support 420, a strap engager 425, a first actuated component 430, and a second actuated component 440.

The strap-engager support 420 is mounted to one end of the shaft 410 and fixed in rotation with the shaft 410 about the axis 400*a* in any suitable manner, such as (but not limited to) via friction fit, adhesive, a set screw or other fastener, a splined connection, or a keyed connection. In this example embodiment, the strap-engager support 420 includes a tubular member defining a partial bore in which the end of the shaft 410 is received. The strap engager 425 is attached to and fixed in rotation with the strap-engager support 420 and extends from the strap-engager support 420 in the fifth direction D5. In this example embodiment, the strap engager 425 is generally parallel to and radially offset from the axis 400*a*. The first actuated component 430 is mounted to the shaft 410 near the end opposite the strap-engager support 420 and is rotationally and longitudinally fixed to the shaft 410 (in any suitable manner, such as any of those listed above) such that it rotates with the shaft 410 and is not longitudinally movable relative to the shaft 410. The second actuated component 440, which is a tubular member in this example embodiment, is mounted to the shaft 410 between its two ends and is rotationally and longitudinally fixed to the shaft 410 (in any suitable manner, such as any of those listed above) such that it rotates with the shaft 410 and is not longitudinally movable relative to the shaft 410.

The leading-strap-end guide 400 is mounted to and rotatably supported by two mounting ears 110*a* and 110*b* of the sealing-assembly frame 100 (such as via suitable bearings) such that the leading-strap-end guide 400 can: (1) rotate about the axis 400*a* relative to the sealing-assembly frame 100 between a home rotational position (FIG. 5A) and a clamping rotational position (FIG. 5F); and (2) longitudinally move in the third and fourth directions D3 and D4 (i.e., along the axis 400*a*) between a home longitudinal position (FIG. 3) and a retracted longitudinal position (FIG. 5I). The leading-strap-end guide 400 is positioned such that the second actuated component 440 is between the mounting ears 110*a* and 110*b*. A leading-strap-end-guide biasing element 490—here a compression spring circumscribing the shaft 410 between the mounting ear 110*a* and the second actuated component 440—biases the leading-strap-end guide 400 to its home longitudinal position. When the leading-strap-end guide 400 is in its home longitudinal position, the first actuated component 430 engages the mounting ear 110*a*, which prevents the leading-strap-end-guide biasing element 490 from moving the leading-strap-end guide 400 past its home longitudinal position. When the leading-strap-end guide 400 is in its retracted longitudinal position, the second actuated element 440 is closer to the mounting ear 110*a*, the first actuated element 430 is further from the mounting ear 110*a*, and the leading-strap-end-guide biasing element 490 is further compressed. As described below, the drive assembly 600 is operably connected to the leading-strap-end guide 400 to: (1) rotate the leading-strap-end guide 400 between its home and clamping rotational positions; and (2) move the leading-strap-end guide 400 between its home and retracted longitudinal positions.

The second strap manipulator 500, which is best shown in FIG. 2, includes a strap-manipulator frame 510 pivotably connected to the sealing-assembly frame 100 and supporting two spaced-apart rails 512 and 514, a base 520 slidably mounted to the rails 512 and 514, a finger support 530 connected to and generally extending from the base 520 in the second direction D2, and a finger 540 extending transversely from the finger support 530 in the fourth direction D4. The finger 540 is movable: (1) in the third and fourth directions D3 and D4 (via pivoting of the strap-manipulator frame 510) between a retracted position (FIG. 2) and a working position (FIG. 5D); and (2) in the first and second directions D1 and D2 (via sliding of the base 520 along the rails 512 and 514) among a home position (FIG. 5D), a clamping-and-cutting position (FIG. 5F), and a sealing position (FIG. 5J).

The drive assembly 600, which is best shown in FIGS. 2-4, drives the welding assembly 300 to manipulate the strap S to form the strap loop around the load. The drive assembly 600 includes a motor 610, a camshaft 620 with multiple cams including a first cam 622 and a second cam 624, a first leading-strap-end-guide actuator 630, and a second leading-strap-end-guide actuator 640.

The camshaft 620—and more particularly the cams fixed in rotation with the camshaft 620—controls the movement of various components of the welding assembly 300 during the strapping cycle. The camshaft 620 is rotatably supported by the sealing-assembly frame 100 via suitable bearings such that the camshaft 620 can rotate relative to the sealing-assembly frame 100. The motor 610 is operably connected to the camshaft 620 (such as via a suitable coupling or a splined or keyed connection) and configured to rotate the camshaft 620 one full rotation (though it may be more than or less than one full rotation in other embodiments) to carry out the strapping cycle. The first cam 622 is shaped, positioned, oriented, and otherwise configured to drive the first leading-strap-end-guide actuator 630 to actuate the leading-strap-end guide 400 (here, move it longitudinally) during the strapping cycle, as described below. The second cam 624 is shaped, positioned, oriented, and otherwise configured to drive the second leading-strap-end-guide actuator 640 to actuate the leading-strap-end guide 400 (here, rotate it) during the strapping cycle, as described below.

The first leading-strap-end-guide actuator 630 is best shown in FIGS. 3 and 4 and is configured to rotate the leading-strap-end guide 400 between its home and clamping rotational positions. The first leading-strap-end-guide actuator 630 includes a first pivot arm 632, a first cam follower 634, and a link 636. The first pivot arm 632 is pivotably mounted at one end to a pivot shaft 600*s* (that is supported by the sealing-assembly frame 100) such that the first pivot arm 632 pivotable about a pivot axis 632*a* that is coaxial with the longitudinal axis of the pivot shaft 600*s*. The first cam follower 634 is mounted to the first pivot arm 632 via a bracket (not labeled) and positioned beneath the first cam 622. The link 636 is rigid and extends between and is connected to the first pivot arm 632 and the first actuated component 430 of the leading-strap-end guide 400. A pivot-arm-biasing element (not shown) biases the first pivot arm 632 in the fifth direction D5 and, therefore, maintains the first cam follower 634 in contact with the first cam 622.

The first leading-strap-end-guide actuator 630 operably connects the first cam 622 to the leading-strap-end guide 400. Specifically, pivoting the first pivot arm 632 in the fifth direction D5 results in the link 636 forcing the leading-strap-end guide 400 to rotate toward its clamping rotational position. Conversely, pivoting the first pivot arm 632 in the sixth direction D6 results in the link 636 forcing the leading-strap-end guide 400 to rotate toward its home rotational position. The first cam 622 is shaped to rotate the leading-strap-end guide 400 in the manner shown in FIGS. 5A-5L during a strapping cycle.

The second leading-strap-end-guide actuator 640 is best shown in FIGS. 3 and 4 and is configured to move the leading-strap-end guide 400 between its home and retracted longitudinal positions. The second leading-strap-end-guide actuator 640 includes a second pivot arm 642, a second cam follower 644, a first link 646, a second link 648, and an engager 649. The second pivot arm 642 is pivotably mounted at one end to the pivot shaft 600*s* such that the second pivot arm 642 pivotable about a pivot axis 642*a* that is coaxial with the longitudinal axis of the pivot shaft 600*s* and the pivot axis 632*a*. The second cam follower 644 is mounted to the second pivot arm 642 via a bracket (not labeled) and positioned adjacent the second cam 624. The first link 646 is rigid and extends between and is connected to the pivot arm 642 and the one and of the second link 648. The second link 648 is rigid and is pivotably supported by the frame 100 such that the second link 648 is pivotable relative to the frame 100. The engager 649 is fixedly mounted to the other end of the second link 648 and contacts the second actuated element 440 of the leading-strap-end guide 400. The leading-strap-end-guide biasing element 490 biases the engager 649 in the third direction D3 and, therefore, maintains the second cam follower 644 in contact with the second cam 624.

The second leading-strap-end-guide actuator 640 operably connects the second cam 624 to the leading-strap-end guide 400. Specifically, pivoting the second pivot arm 642 in the third direction D3 results in the second link 648 moving the engager 649 in the fourth direction D4 and forcing the leading-strap-end guide 400 to move toward its retracted longitudinal position. Conversely, pivoting the second pivot arm 642 in the fourth direction D4 results in the second link 648 moving the engager 649 in the third direction D3, enabling the leading-strap-end-guide biasing element 490 to force the leading-strap-end guide 400 to move toward its home longitudinal position. The second cam 624 is shaped to longitudinally move the leading-strap-end guide 400 in the manner described in conjunction with FIGS. 5A-5L during a strapping cycle Although not labeled or described in detail, the drive assembly 600 includes suitable actuators (not labeled or shown in detail) that operably connect certain of the other cams on the camshaft 620 to the counter-pressure plate 310, the heating element 320, the first strap clamp 330, the second strap clamp 340, the third strap clamp 350, and the fourth strap clamp 360 of the welding assembly 300 to move these components as described herein as the camshaft 620 rotates during the strapping cycle. Additionally, although not labeled or described in detail, the drive assembly 600 includes suitable actuators (not labeled or shown in detail) that operably connect certain of the other cams on the camshaft 620 (or otherwise) to the strap-manipulator frame 510 of the second strap manipulator 500 to pivot it and to the base 520 of the second strap manipulator 500 to move it to move the finger 540 as described herein as the camshaft 620 rotates during the strapping cycle.

The controller includes a processing device (or devices) communicatively connected to a memory device (or devices). For instance, the controller may be a programmable logic controller. The processing device may include any suitable processing device such as, but not limited to, a general-purpose processor, a special-purpose processor, a digital-signal processor, one or more microprocessors, one or more microprocessors in association with a digital-signal processor core, one or more application-specific integrated circuits, one or more field-programmable gate array circuits, one or more integrated circuits, and/or a state machine. The memory device may include any suitable memory device such as, but not limited to, read-only memory, random-access memory, one or more digital registers, cache memory, one or more semiconductor memory devices, magnetic media such as integrated hard disks and/or removable memory, magneto-optical media, and/or optical media. The memory device stores instructions executable by the processing device to control operation of the strapping machine 1. The controller is communicatively and operably connected to the motor 610 and configured to receive signals from and to control the motor 610. The controller may also be communicatively connectable (such as via Wi-Fi, Bluetooth, near-field communication, or other suitable wireless communications protocol) to an external device, such as a computing device, to send information to and receive information from that external device.

FIGS. 5A-5L show certain components of the welding assembly 300 for an example strapping cycle during which a loop of strap S is formed around a load L. Initially, as shown in FIG. 5A: (1) the counter-pressure plate 310 is in its home position; (2) the heating element 320 is in its home position; (3) the first and second strap clamps 330 and 340 are in their respective first clamping positions and clamping and holding the leading end LE of the strap S between the clamping surfaces 330*s* and 3401; (4) the third strap clamp 350 is in its release position; (5) the fourth strap clamp 360 is in its release position; (6) the leading-strap-end guide 400 is in its home rotational and longitudinal positions; and (7) the finger 540 of the second strap manipulator 500 is in its retracted and home positions. The strap S extends from its leading end LE, partially curls around the strap engager 425, and up through an opening (not shown) in the work platform W to the strap supply 900 (not shown in FIGS. 5A-5L).

FIG. 5B shows the welding assembly 300 after the load L has reached the welding position shown in FIG. 1C. The engagement of the strap S by the load L has caused the strap S to curl further around the strap engager 425 and extend across the clamping surface 340*u* of the second strap clamp 340, the clamping surface 350*s* of the third strap clamp 350, and the clamping surface 360*s* of the fourth strap clamp 360.

FIG. 5C shows the welding assembly 300 after the first strap manipulator 1000 has moved in the sixth direction D6 to its sealing position below the work platform W and adjacent the sealing assembly 10, as shown in FIG. 1D. Since the finger 540 is in its retracted position, the finger 540 is out of the plane of the strap S and does not interfere with this movement of the first strap manipulator 1000.

FIG. 5D shows the welding assembly 300 after: (1) the counter-pressure plate 310 has moved to its sealing position; (2) the third strap clamp 350 has moved to its first clamping position to clamp a portion of the strap S between the clamping surface 350*s* of the third strap clamp 350 and the lower surface 3101 of the counter-pressure plate 310; (3) the fourth strap clamp 360 has moved to its clamping position to clamp a portion of the strap S between the clamping surface 360*s* of the fourth strap clamp 360 and the lower surface 3101 of the counter-pressure plate 310; and (4) the finger 540 has moved to its working position such that it is positioned between the two vertically extending portions of the strap S extending from the first strap manipulator 1000.

Figure 5E:
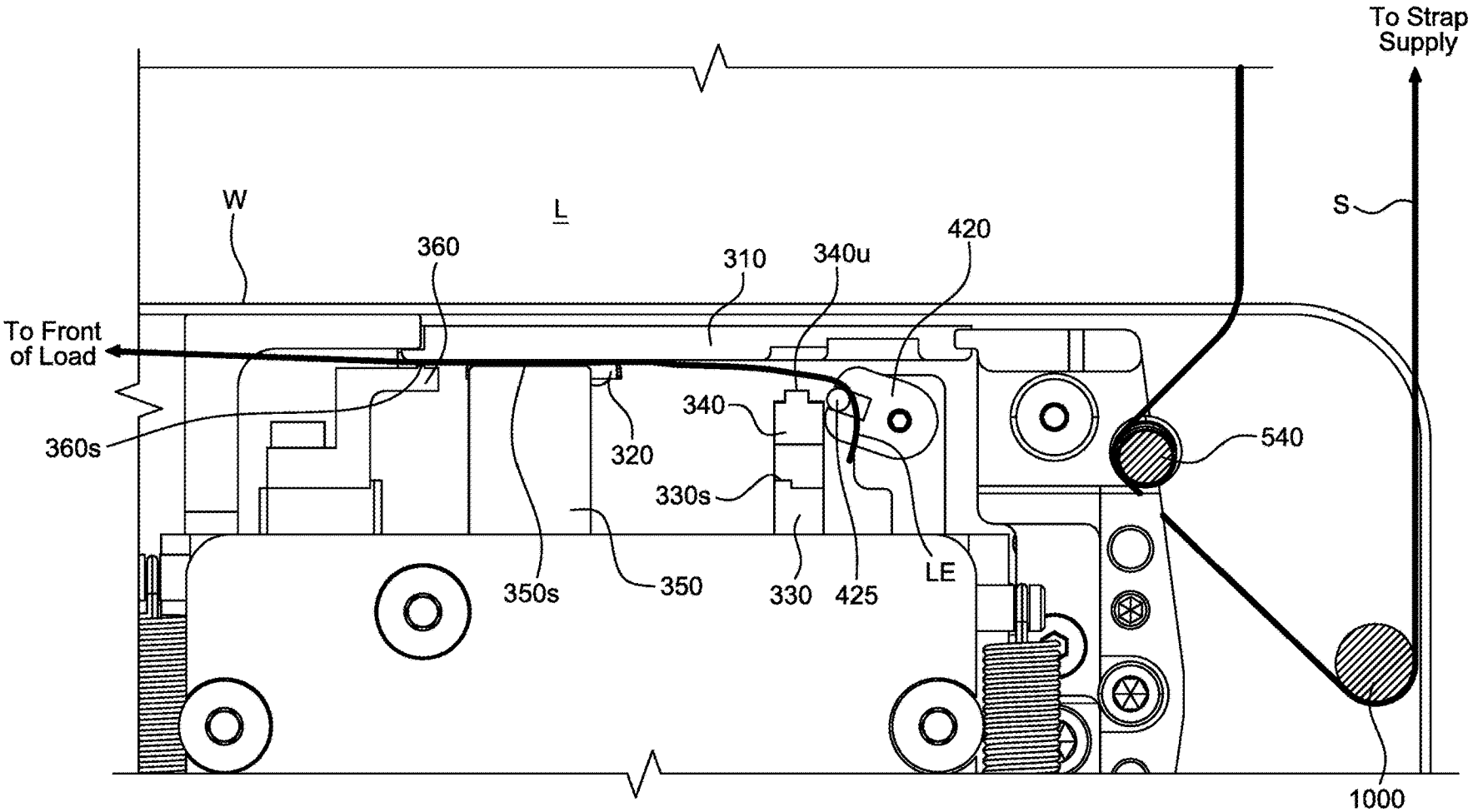

FIG. 5E shows the welding assembly 300 after: (1) the first and second strap clamps 330 and 340 have moved to their respective release positions to release the leading strap end LE; (2) the leading-strap-end guide 400 has begun rotating toward its clamping rotational position; and (3) the finger 540 has begun moving toward its clamping-and-cutting position. If the leading strap end LE gets stuck on one of or between the first and second strap clamps 330 and 340, the rotating strap engager 425 pulls the leading strap end LE from between the clamps as it rotates. As the finger 540 moves toward its clamping-and-cutting position, it engages the strap S and pulls the strap S with it.

Figure 5F:
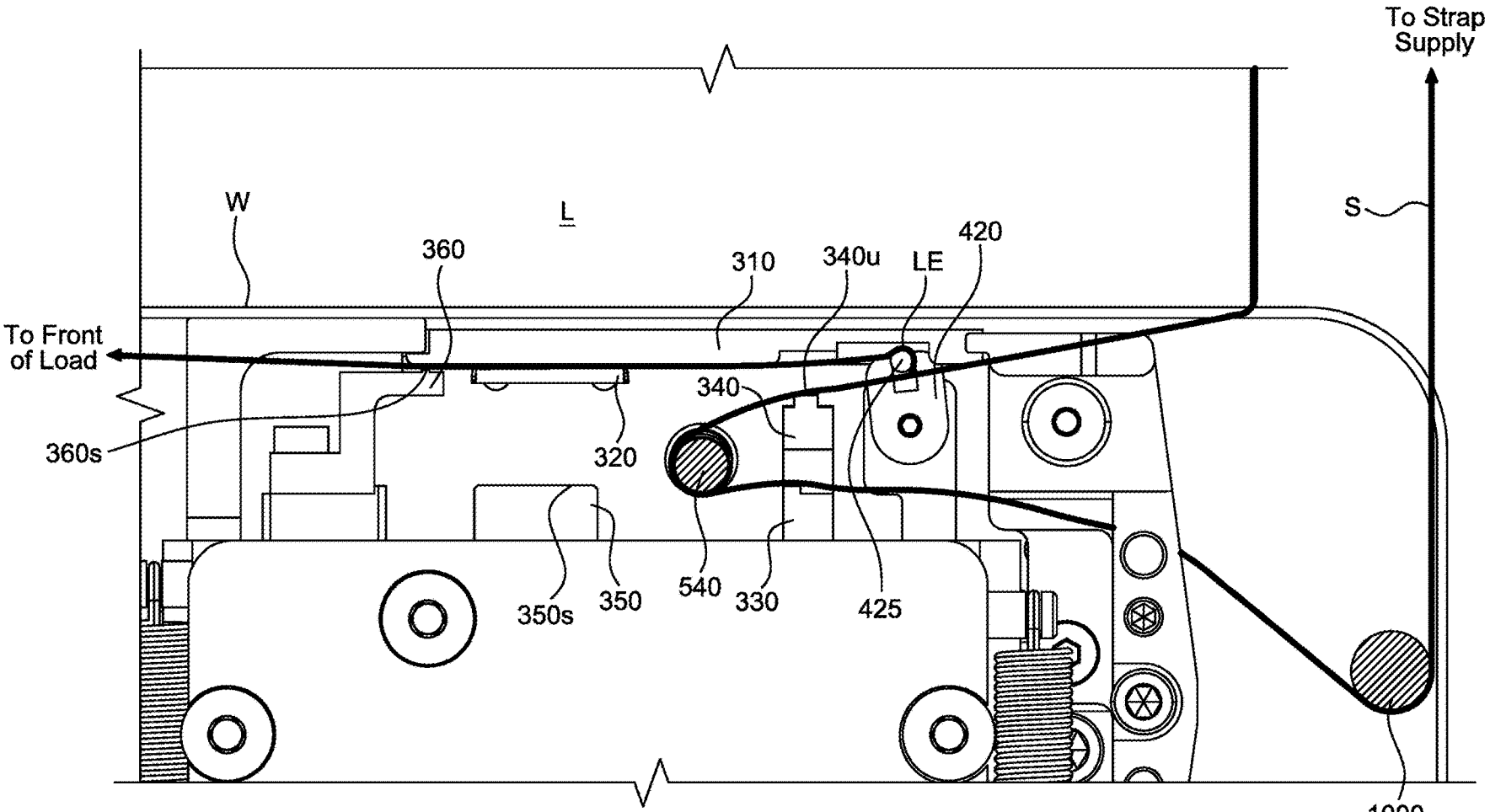

FIG. 5F shows the welding assembly 300 after: (1) the second strap clamp 340 has moved to its first clamping position; (2) the third strap clamp 350 has moved to its release position to release the strap; (3) the leading-strap-end guide 400 has reached its clamping rotational position to clamp a portion of the strap S adjacent the leading strap end LE against the lower surface 3101 of the counter-pressure plate 310; and (4) the finger 540 has reached its clamping-and-cutting position. The timing of the movement of the second strap clamp 340 and the finger 540 results in: (a) a portion of the strap pulled by the finger 540 being positioned between the clamping surface 330*s* of the first strap clamp 330 and the lower clamping surface 3401 of the second strap clamp 340; and (b) another portion of the strap pulled by the finger 540 being positioned between the upper clamping surface 340*u* of the second strap clamp 340 and the lower surface 3101 of the counter-pressure plate 310.

The position of the leading-strap-end guide 400, and particularly the strap engager 425 relative to the strap S before the first and second strap clamps 330 and 340 release the leading strap end LE, ensures strap engager 425 can engage the leading strap end LE or a portion of the strap adjacent the leading strap end (to the extent needed) during the entire rotation from home rotational position to the clamping rotational position. Certain known welding assemblies rely on the strap "springing" out of the first and second strap clamps into a particular position to enable a vertically translating leading-strap-end clamp to clamp the leading end onto the counter-pressure plate. If the strap does not "spring" into place as expected, these known leading-strap-end clamps miss the strap and do not clamp it against the counter-pressure plate, which means no strap loop is formed around the load. The leading-strap-end guide of the present disclosure solves this problem by being positioned and configured to, if needed, guide the leading strap end up to the counter-pressure plate.

Figure 5G:
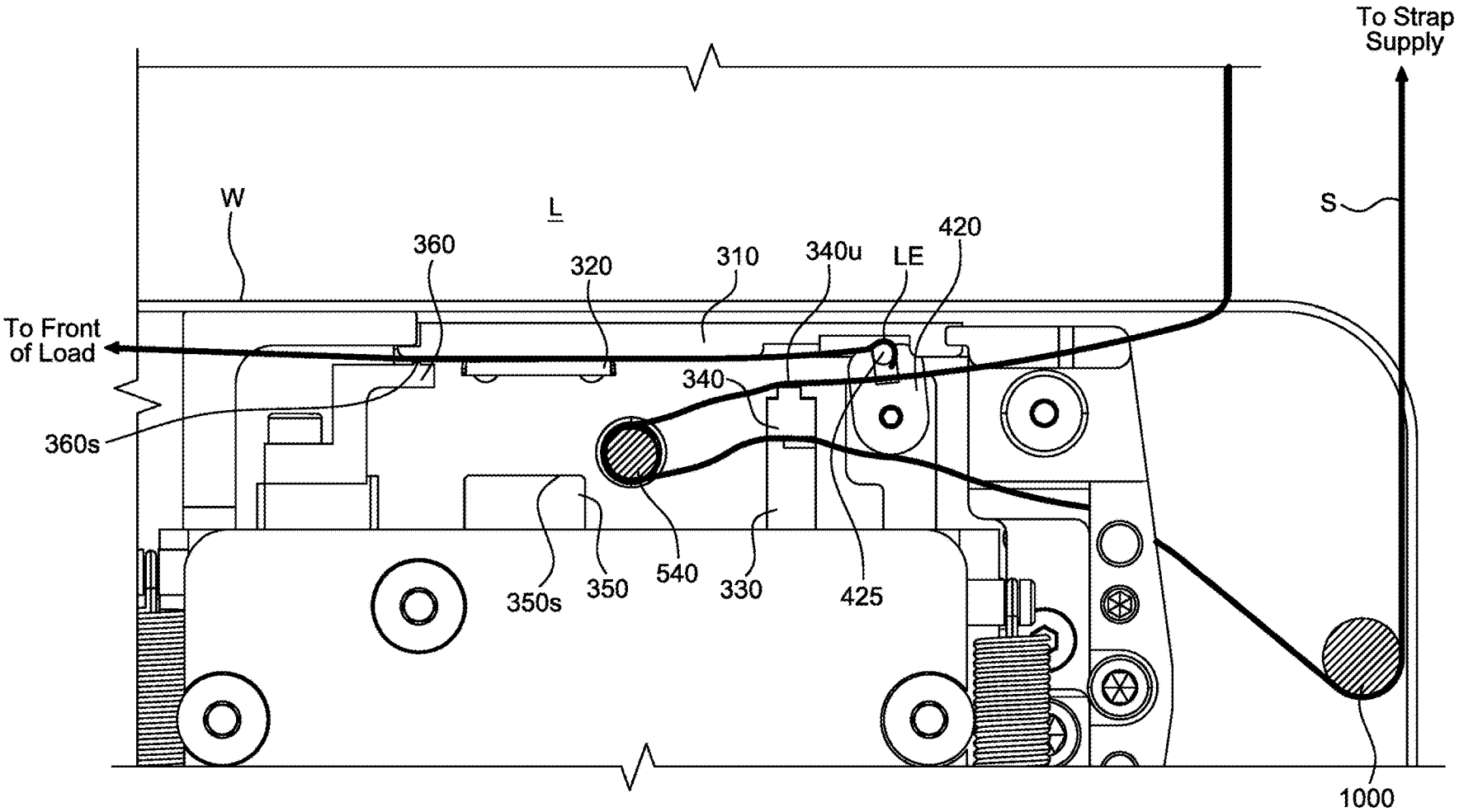
Figure 5H:
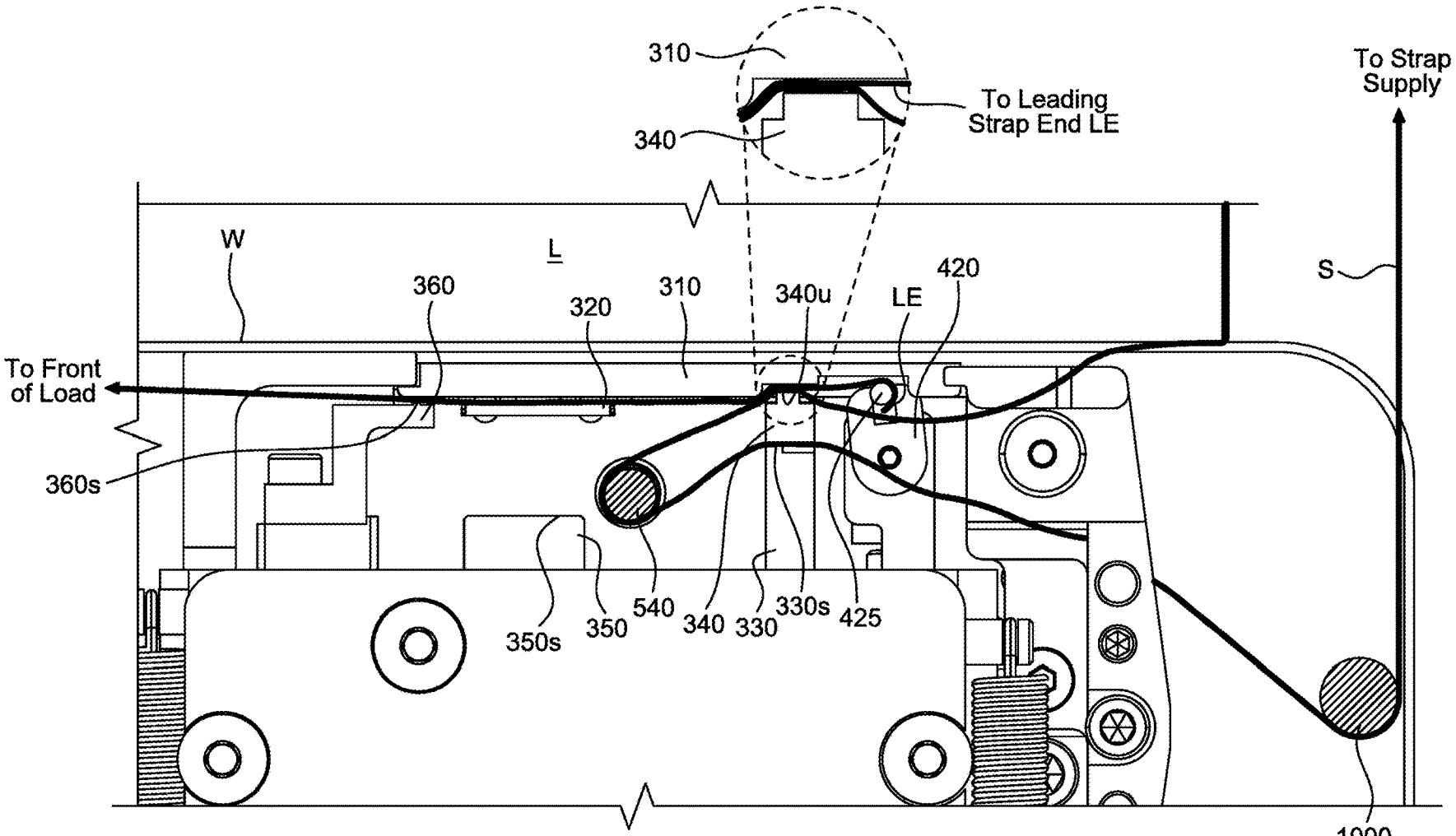
Figure 5I:
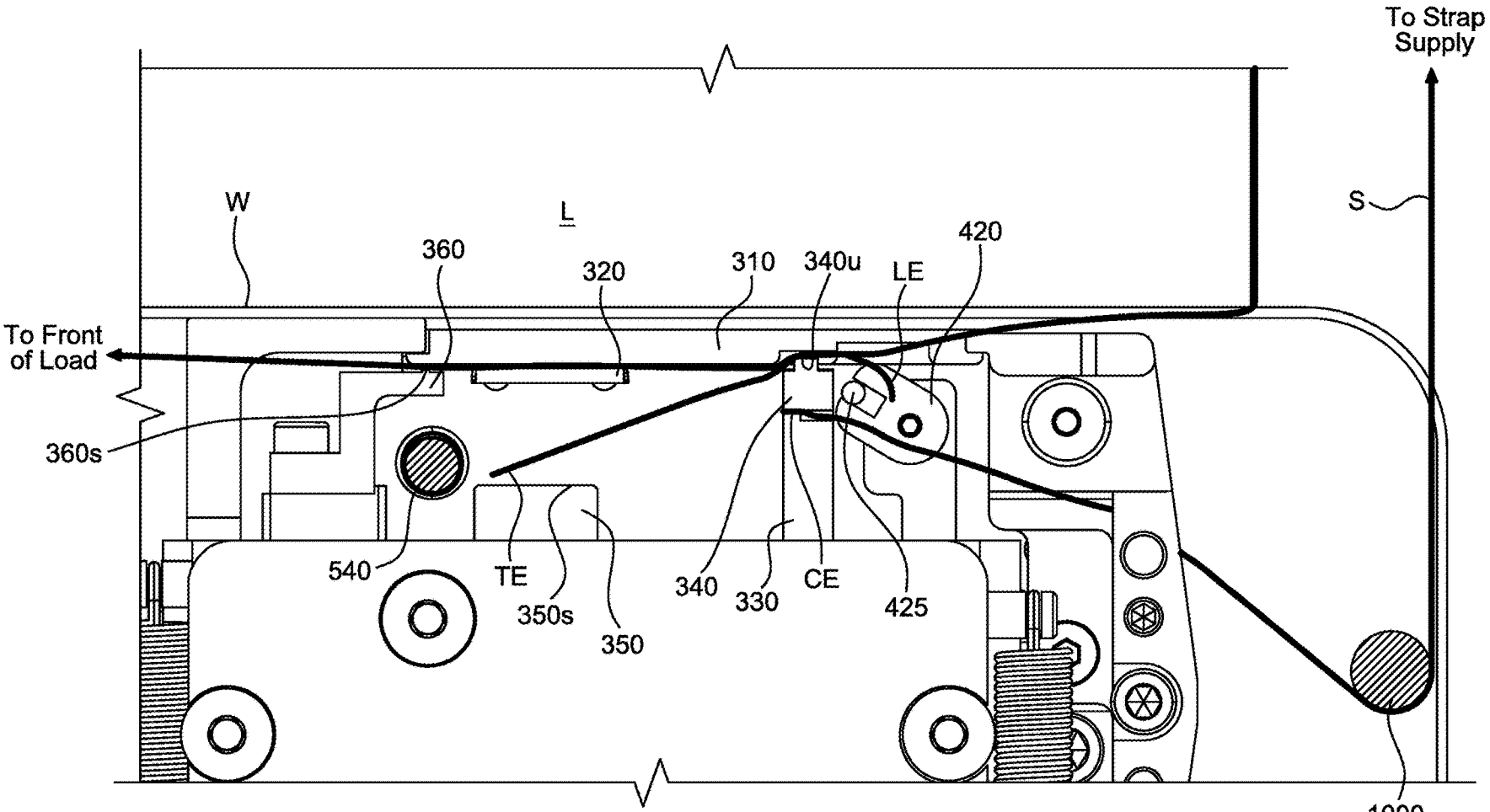
Figure 5J:
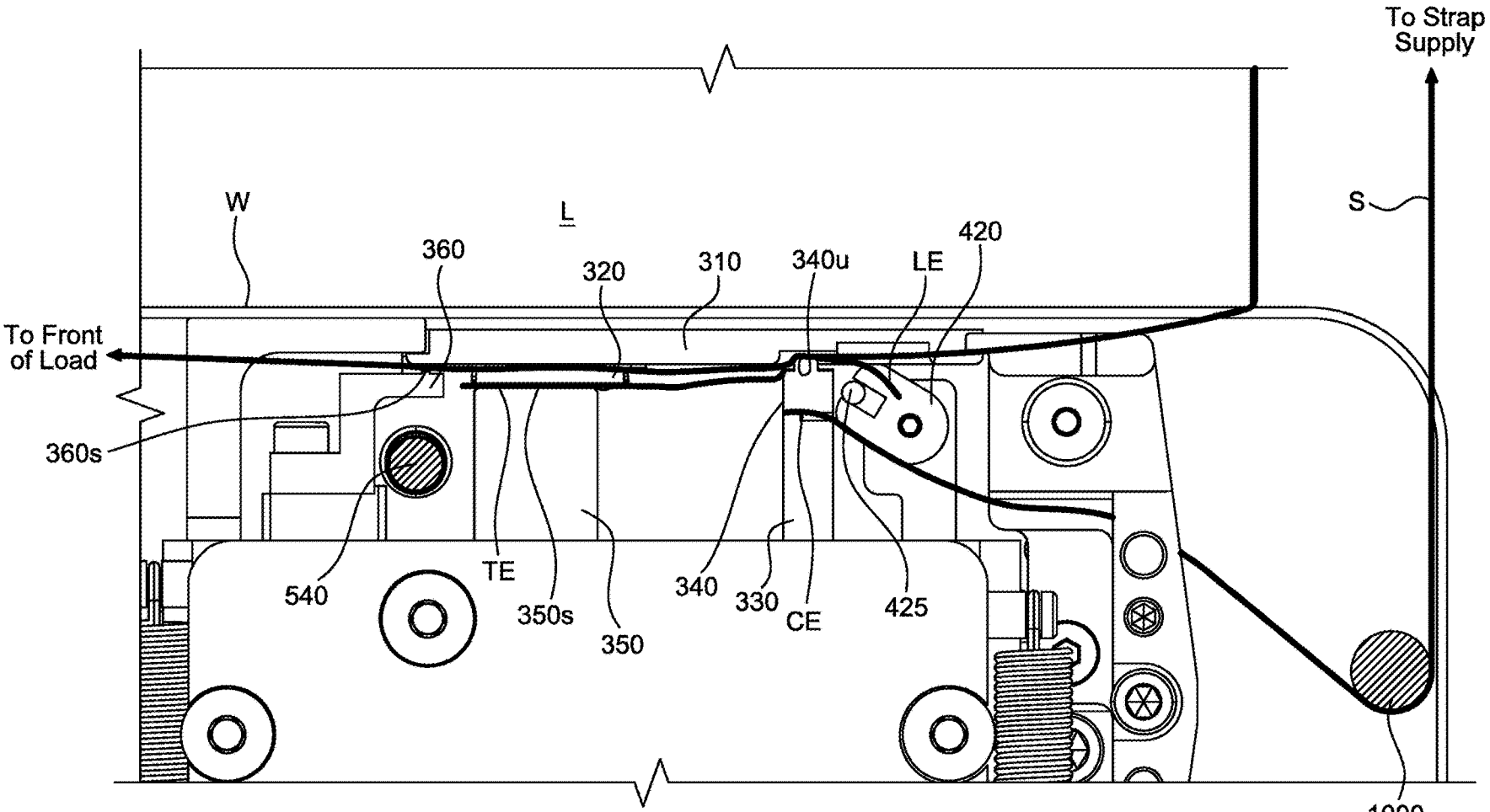

FIG. 5G shows the welding assembly 300 after the first strap clamp 330 has moved to its first clamping position to clamp a portion of the strap S between the clamping surface 330*s* of the first strap clamp 330 and the lower clamping surface 3401 of the second strap clamp 340.

FIG. 5H shows the welding assembly 300 after the first and second strap clamps 330 and 340 has moved to their second clamping positions to clamp a portion of the strap S between the upper clamping surface 340*u* of the second strap clamp 340 and the lower surface 3101 of the counter-pressure plate 310.

FIG. 5I shows the welding assembly 300 after: (1) a cutting device (not shown) has cut the strap S to create a trailing strap end TE and a cut strap end CE that remains clamped between the first and second strap clamps; (2) the finger 540 has continued moving toward its sealing position to pull the trailing strap end TE across the third strap clamp 350; (3) the heating element 320 moved to its sealing position; and (4) the leading-strap-end guide 400 has rotated slightly toward its home rotational position to release the portion of the strap S adjacent leading strap end LE and has moved to its retracted longitudinal position. At this point in time: (a) a portion of the strap adjacent the leading strap end LE is positioned between the upper surface 320*u* of the heating element 320 and the lower surface 3101 of the counter-pressure plate; and (b) another portion of the strap adjacent the trailing strap end TE is positioned between the lower surface 3201 of the heating element 320 and the clamping surface 350*s* of the third strap clamp 350.

FIG. 5J shows the welding assembly 300 after: (1) the finger 540 has reached its sealing position; (2) the third strap clamp 350 has moved to its second clamping position to clamp a portion of the strap S between the clamping surface 350*s* of the third strap clamp 350 and the lower surface 3201 of the heating element 320 and another portion of the strap S between the upper surface 320*u* of the heating element 320 and the lower surface 3101 of the counter-pressure plate; and (3) the heating element 320 has been activated to heat up and soften the portions of the strap clamped against the heating element 320.

Figure 5K:
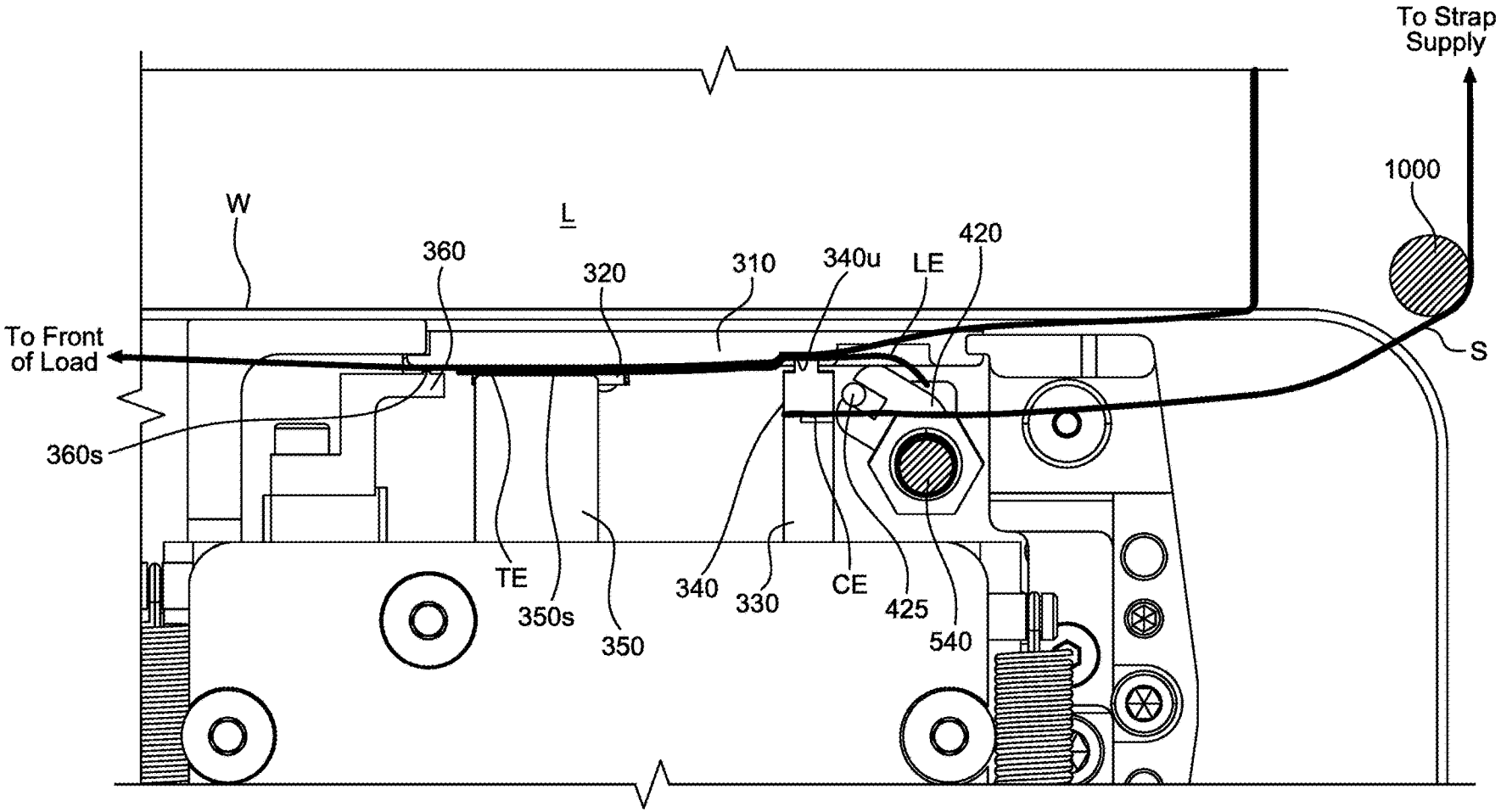

FIG. 5K shows the welding assembly 300 after: (1) the finger 540 has begun moving back to its home position; (2) the heating element has moved to its home position; and (3) the third strap clamp 350 has moved to its first clamping position to clamp the softened portions of the strap against one another to and between the clamping surface 350*s* of the third strap clamp 350 and the lower surface 3101 of the counter-pressure plate 310. This attaches the portions of the strap to one another and forms the strap loop around the load L.

Figure 5L:
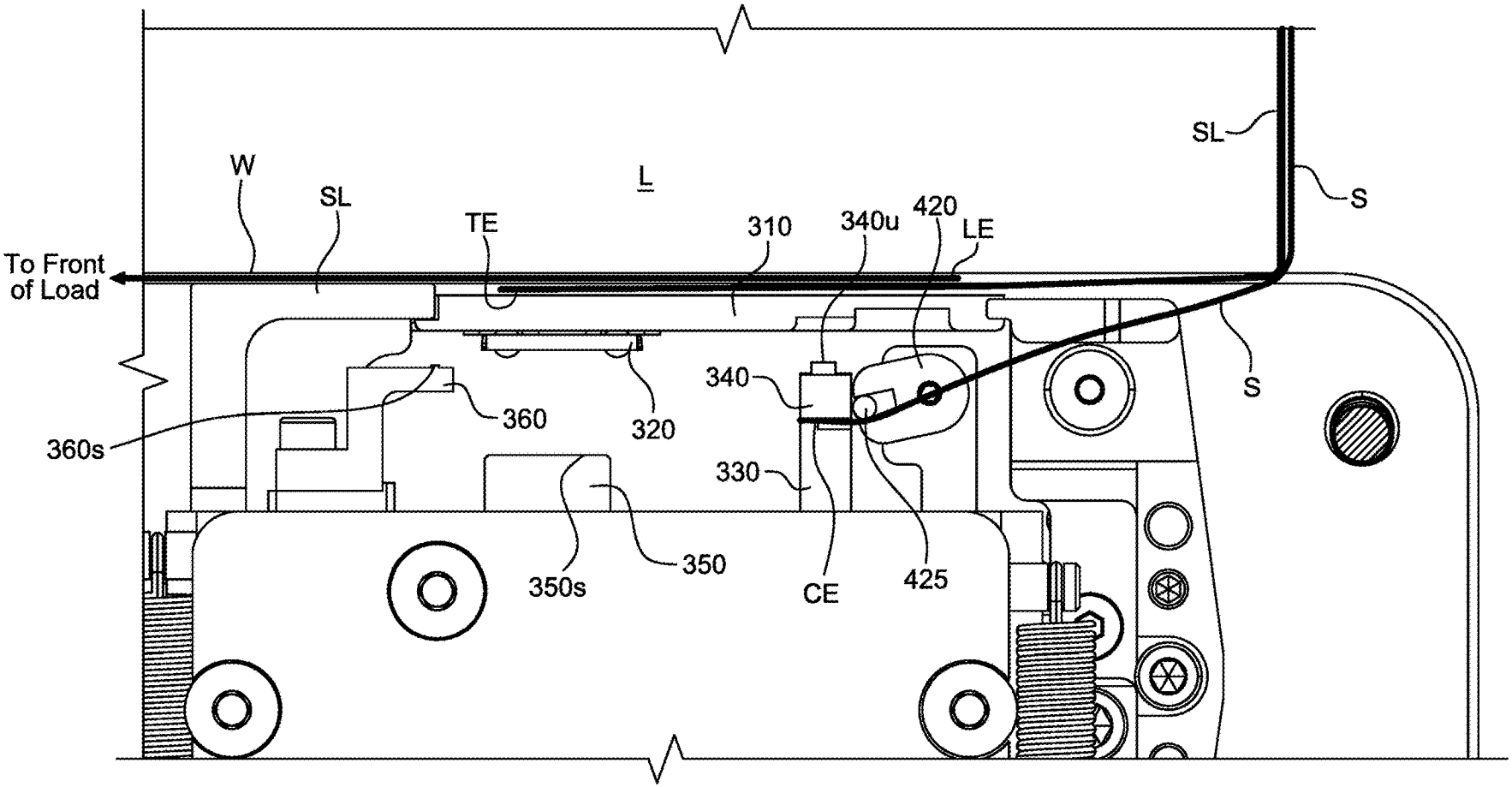

FIG. 5L shows the welding assembly 300 after: (1) the first and second strap clamps 330 and 340 have moved to their first clamping positions to release the strap loop SL while still clamping the cut strap end CE (which is the leading strap end for the next strapping cycle); (2) the third and fourth strap clamps 350 and 360 have moved to their release positions to release the strap loop; (3) the counter-pressure plate 310 has moved to its home position to release the strap loop; (4) the leading-strap-end guide 400 has returned to its home rotational and longitudinal positions; and (5) the finger 540 of the second strap manipulator 500 has returned to its retracted and home positions. The welded portions of the strap loops SL adjacent the leading and trailing strap ends LE and TE are shown spaced apart for clarity and ease of reference, though in reality these portions would be connected.

In other embodiments, rather than being rotatable to move the strap engager to guide the leading strap end to the counter-pressure plate and to clamp the leading strap end against the counter-pressure plate, the leading-strap-end guide is translatable (similar to the third strap clamp 350) in the directions D5 and D6 to do so.

The invention claimed is:

1. A strapping machine comprising:
- a frame;
- a work platform supported by the frame; and
- a sealing assembly below the work platform, the sealing assembly comprising:
  - a welding assembly comprising:
    - a counter-pressure plate movable between a plate home position and a plate sealing position;
    - a first strap clamp movable between a first release position and a first clamping position;
    - a second strap clamp movable between a second release position and a second clamping position; and
    - a leading-strap-end guide movable relative to the first and second strap clamps between a guide home position and a guide clamping position and comprising a strap engager; and
  - a drive assembly operably connected to the counter-pressure plate, the first strap clamp, the second strap clamp, and the leading-strap-end guide to, after a leading strap end of a strap is clamped between the first and second strap clamps in the first and second clamping positions, respectively, and the strap is manipulated to curl around the strap engager in an engager home position:
  - cause the counter-pressure plate to move from the plate home position to the plate sealing position;
  - cause the first and second strap clamps to move to the first and second release positions respectively, to release the leading strap end; and
  - cause the leading-strap-end guide to move to the guide clamping position to clamp a portion of the strap adjacent the leading strap end against the counter-pressure plate;
  - wherein the leading-strap end guide is rotatable relative to the first and second strap clamps, wherein the guide home position is a home rotational position and the guide clamping position is a clamping rotational position.

2. The strapping machine of claim 1, wherein the drive assembly further comprises a leading-strap-end-guide actuator operably connected to the leading-strap-end guide to rotate the leading-strap-end guide between the home and clamping rotational positions.

3. The strapping machine of claim 2, wherein the sealing assembly further comprises a sealing-assembly frame, wherein the drive assembly further comprises a camshaft supported by the sealing-assembly frame and a motor operably connected to the camshaft to rotate the camshaft, wherein the camshaft comprises a cam operably connected to the leading-strap-end-guide actuator to drive the leading-strap-end-guide actuator to rotate the leading-strap-end guide.

4. The strapping machine of claim 3, wherein the leading-strap-end guide actuator comprises:

a pivot arm pivotable relative to the sealing-assembly frame;

a cam follower supported by the pivot arm and biased into engagement with the cam; and a link connecting the pivot arm to the leading-strap-end guide such that pivoting of the pivot arm causes rotation of the leading-strap-end guide.

5. The strapping machine of claim 1, wherein the leading-strap-end guide is longitudinally movable relative to the first and second strap clamps between a home longitudinal position and a retracted longitudinal position.

6. The strapping machine of claim 5, wherein the drive assembly is operably connected to the leading-strap-end guide to rotate the leading-strap-end guide from the clamping rotational position toward the home rotational position to release the portion of the strap adjacent the leading strap end and then move the leading-strap-end guide to the retracted longitudinal position.

7. The strapping machine of claim 6, wherein the drive assembly further comprises a leading-strap-end-guide actuator operably connected to the leading-strap-end guide to move the leading-strap-end guide between the home and retracted longitudinal positions.

8. The strapping machine of claim 7, wherein the sealing assembly further comprises a sealing-assembly frame, wherein the drive assembly further comprises a camshaft supported by the sealing-assembly frame and a motor operably connected to the camshaft to rotate the camshaft, wherein the camshaft comprises a cam operably connected to the leading-strap-end-guide actuator to drive the leading-strap-end-guide actuator to longitudinally move the leading-strap-end guide.

9. The strapping machine of claim 8, wherein the leading-strap-end guide actuator comprises:

a pivot arm pivotable relative to the sealing-assembly frame;

a cam follower supported by the pivot arm and biased into engagement with the cam; and one or more links connecting the pivot arm to an engager that engages the leading-strap-end guide such that pivoting of the pivot arm causes longitudinal movement of the leading-strap-end guide.

10. The strapping machine of claim 1, wherein the sealing assembly further comprises a sealing-assembly frame, wherein the leading-strap-end guide is longitudinally movable relative to the first and second strap clamps between a home longitudinal position and a retracted longitudinal position, wherein the drive assembly is operably connected to the leading-strap-end guide to rotate the leading-strap-end guide from the clamping rotational position toward the home rotational position to release the portion of the strap adjacent the leading strap end and then move the leading-strap-end guide to the retracted longitudinal position, wherein the drive assembly further comprises a first leading-strap-end-guide actuator operably connected to the leading-strap-end guide to rotate the leading-strap-end guide between the home and clamping rotational positions and a second leading-strap-end-guide actuator operably connected to the leading-strap-end guide to move the leading-strap-end guide between the home and retracted longitudinal positions, wherein the drive assembly further comprises a camshaft supported by the sealing-assembly frame and a motor operably connected to the camshaft to rotate the camshaft, wherein the camshaft comprises a first cam operably connected to the first leading-strap-end-guide actuator to drive the first leading-strap-end-guide actuator to rotate the leading-strap-end guide and a second cam operably connected to the second leading-strap-end-guide actuator to drive the second leading-strap-end-guide actuator to longitudinally move the leading-strap-end guide.

11. The strapping machine of claim 10, wherein the first leading-strap-end guide actuator comprises a first pivot arm pivotable relative to the sealing-assembly frame, a first cam follower supported by the first pivot arm and biased into engagement with the first cam; and a first link connecting the first pivot arm to the leading-strap-end guide such that pivoting of the first pivot arm causes rotation of the leading-strap-end guide, wherein the second leading-strap-end guide actuator comprises a second pivot arm pivotable relative to the sealing-assembly frame, a second cam follower supported by the second pivot arm and biased into engagement with the second cam, and one or more second links connecting the second pivot arm to an engager that engages the leading-strap-end guide such that pivoting of the second pivot arm causes longitudinal movement of the leading-strap-end guide.

* * * * *